US006799113B2

(12) United States Patent
Denz et al.

(10) Patent No.: US 6,799,113 B2
(45) Date of Patent: Sep. 28, 2004

(54) METHOD AND ARRANGEMENT FOR CONTROLLING THE DRIVE UNIT OF A VEHICLE

(75) Inventors: Helmut Denz, Stuttgart (DE); Werner Hess, Stuttgart (DE); Martin Ludwig, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 247 days.

(21) Appl. No.: 09/992,015

(22) Filed: Nov. 26, 2001

(65) Prior Publication Data

US 2002/0065598 A1 May 30, 2002

(30) Foreign Application Priority Data

Nov. 24, 2000 (DE) ..... 100 58 354

(51) Int. Cl.[7] ..... F02D 41/14

(52) U.S. Cl. ..... 701/110; 123/320; 123/325; 123/329

(58) Field of Search ..... 701/110; 123/320, 123/325, 327, 329, 332, 333, 350

(56) References Cited

U.S. PATENT DOCUMENTS 4,846,127 A * 7/1989 Miyama et al. ..... 123/325

* cited by examiner

*Primary Examiner*—Andrew M. Dolinar
(74) *Attorney, Agent, or Firm*—Walter Ottesen

(57) ABSTRACT

A method and an arrangement control the drive unit of a vehicle. In this method and arrangement, an rpm limiting to a reference rpm takes place when the demand of the driver is withdrawn. The reference rpm is determined at the start of the withdrawal of the driver command.

13 Claims, 3 Drawing Sheets

METHOD AND ARRANGEMENT FOR CONTROLLING THE DRIVE UNIT OF A VEHICLE

BACKGROUND OF THE INVENTION

In the control of drive units of motor vehicles, the reduction of the torque is delayed when there is a rapid withdrawal of the accelerator pedal by the driver in order to improve comfort (the so-called dashpot functions or load-impact damping functions). In this way, a damping of the otherwise occurring jolt is achieved. However, it is to be noted that an rpm overshoot is triggered which reduces driving comfort when there is a withdrawal of the accelerator pedal with a simultaneous pressing of the clutch pedal when the dashpot function is active. A solution for improvement would be to switch off this load-impact damping function when the clutch is actuated. However, for this purpose, the actuation of the clutch pedal has to be detected, for example, by means of switches or algorithms. A procedure of this kind is described, for example, in German patent publication 198 27 585. On the other hand, the use of clutch switches or of algorithms to detect the clutch actuation can be associated with problems with respect to the required accuracy. If, for example, a clutch switch is adjusted inaccurately, then, even though the clutch is depressed but the drive train not separated, the dashpot function does not operate so that a noticeable jolt can occur. If no clutch actuation is detected notwithstanding a separated drive train, then this leads to the overshoots which likewise negatively affect driving comfort.

An rpm overshoot is effectively prevented by the activation of an rpm limiter when withdrawing the accelerator pedal. This is done without detecting an actuation of the clutch pedal and/or a separation in the drive train. In this way, an rpm overshoot when disengaging the clutch is prevented during or after withdrawing the accelerator pedal under all conditions, also without clutch switches.

SUMMARY OF THE INVENTION

A jolt is effectively prevented by the continuous withdrawal of the rpm limiting intervention signal (torque reduction) when depressing the accelerator pedal after a deceleration already in advance of dropping the rpm via the limiting intervention.

The method of the invention is for controlling a motor of a vehicle and includes: determining the rpm of the motor and a quantity representing a command of the driver of the vehicle; determining a reference rpm of the motor at the start of a withdrawal of the command by the driver; and, limiting the rpm of the motor to the reference rpm when the driver withdraws the command.

Clutch switches or algorithms for detecting the clutch pedal actuation can be omitted without limiting comfort or limiting function.

Furthermore, a slight reduction of consumption and emission results via the immediate charge reduction for rpm overshoots because, in this case, the dashpot termination does not become effective, as well as via an immediately triggered overrun cutoff without further delay time as soon as the overrun state is detected.

The shift operation and the shift comfort are considerably improved overall by the introduction of the rpm limiter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
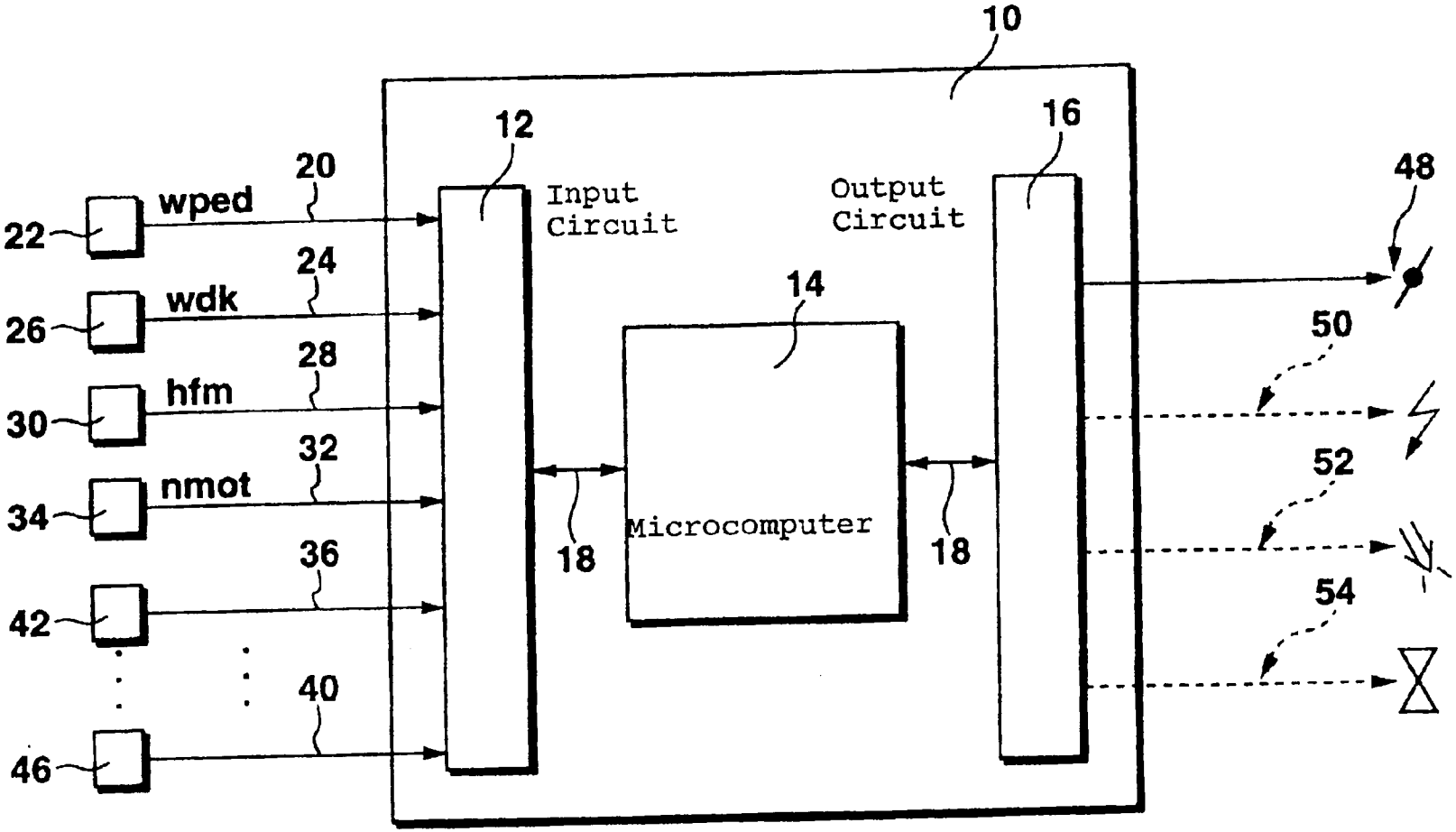
FIG. 1 is a block diagram showing a control arrangement for controlling an internal combustion engine as a preferred area of application of the procedure according to the invention.

FIG. 1 shows an electronic control apparatus 10 which includes at least an input circuit 12, a microcomputer 14 and an output circuit 16. The input circuit, microcomputer and output circuit are interconnected via a communications system 18 for mutual data exchange. The following input lines lead to the input circuit 12: an input line 20 from a measuring device 22 for detecting the accelerator pedal position wped; an input line 24 from a measuring device 26 for detecting the throttle flap position wdk; and input line 28 from a measuring device 30 for detecting the air mass hfm which is supplied to the internal combustion engine; an input line 32 from a measuring device 34 for detecting the engine rpm nmot; and, input lines 36 to 40 from measuring devices 42 to 46, respectively, for detecting further operating variables of the engine and/or of the vehicle, which are necessary for carrying out the control of the engine such as intake air temperature, ambient pressure, et cetera. The electronic control apparatus 10 controls power parameters of the engine via the output circuit 16. Accordingly, the charge of the engine is controlled by influencing the air supply of the engine via a throttle flap 48. Furthermore, the ignition time point 50 is adjusted, the metering of fuel is influenced 52 and/or a turbocharger 54 is controlled.

The operation of the engine control, which is carried out by the control apparatus 10, is known from the state of the art. A desired value for a torque of the engine is determined at least on the basis of the accelerator pedal position wped and corresponds to the driver command. This desired value is converted into a torque desired value, if required, while considering further desired torques from external and internal functions such as drive slip control, rpm limiting, speed limiting, et cetera. The torque desired value is converted into a desired value for the charge, that is, for the relative air charge per cylinder stroke standardized to a maximum possible cylinder charge, while at least considering the engine rpm in corresponding characteristic fields, tables or computation steps. In dependence upon this desired charge value, a desired throttle flap position value is determined while considering the physical interrelationships in the intake manifold. The desired value is then adjusted via a corresponding control loop. Furthermore, the ignition angle and/or the fuel metering is influenced, if required, while considering the actual torque which, for example, is computed on the basis of the air mass signal. The actual torque is caused to approach the desired value.

A procedure is described above for an air-guided engine control. The limiter which is described hereinafter is, however, also used when the fuel quantity is determined from the driver command and the engine is operated almost unthrottled as in some operating modes of an internal combustion engine having gasoline direct injection and for diesel engines. The rpm limiter can be correspondingly applied even with alternative drive concepts, for example, electric motors. The intervention quantities for engine rpm control are then correspondingly adapted.

Figure 2:
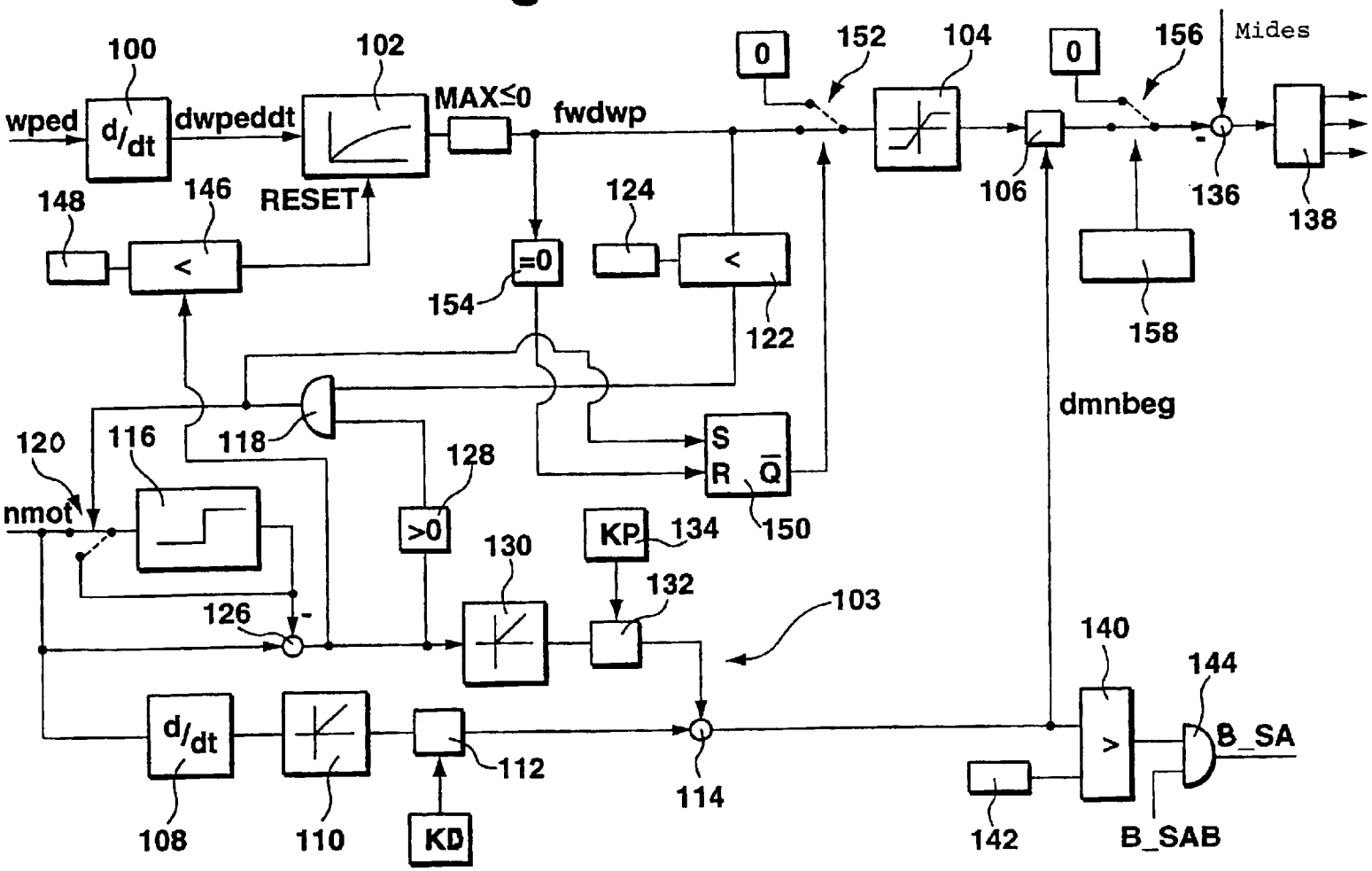
FIG. 2 is a flowchart which shows the rpm limiting for load withdrawal; and, FIGS. 3*a* to 3*d* are time diagrams showing the operation of the rpm limiter.

The flowchart of FIG. 2 presents a preferred embodiment of the rpm limiter. The flowchart represents a computer program which is stored and executed in the microcomputer 14 of the control apparatus 10 or is loaded into the microcomputer by an external data carrier and is executed.

The operation of the rpm limiter is as follows. When the driver withdraws the accelerator pedal, then the current rpm value is stored. The rpm is then limited to this stored value as an upper rpm value in that, in the preferred application of an internal combustion engine, a rapid torque withdrawal in the case where the rpm limit value is exceeded is realized in addition to the torque reduction (for example, charge reduction) triggered by the pedal withdrawal. The rapid torque withdrawal in the case of exceeding the rpm limit value takes place, for example, by a retardation of the ignition angle or, when required and permitted, by suppressing individual injections.

The flowchart in FIG. 2 shows a preferred realization of the limiter. The individual blocks define individual programs, subprograms or program steps, whereas the connecting lines show the flow of information.

Starting from the measured accelerator pedal angle wped, the time-dependent change (derivative) dwpeddt of the accelerator pedal angle signal is formed in 100, for example, by difference formation. This value is conducted to a lowpass filter 102 whose content and output is limited to values less than or equal to 0. The negative accelerator pedal position change is stored in the possibly limited output signal of the lowpass 102 for a certain time (corresponding to the time constant of the lowpass). This signal functions to weight the rpm limit signal in order to ensure a continuous and jolt-free transition for a renewed depression of the accelerator pedal during a still active rpm limiting. The output signal value fwdwp of the lowpass is limited in a limiter 104 to a minimum value in order to prevent or to minimize fluctuations of the limiter intervention signal via a too large amplification (weighting) of the rpm limiter output signal. The logic position 106 is preferably configured as a multiplication position and, in the logic position 106, the output signal fwdwp of the lowpass 102 is logically coupled to the output signal dmnbeg of the rpm limiter 103.

An engine rpm signal nmot is supplied to the rpm limiter. In the preferred embodiment, an rpm value is used for rpm limiting, which is averaged over at least two rpm values, for example, prefiltered by a sliding mean value formation over two or more segments. The time-dependent derivative of the rpm or the time-dependent rpm change is determined from this rpm value by means of the differentiator 108. This rpm or rpm change is limited in the limiter 110 to positive values and is logically coupled with a factor KD in the logic position 112, especially, multiplied. The output signal of the logic position 112 defines the differential component of the rpm limiter output signal. The differential component is joined in a logic position 114 to a second component, preferably, a proportional component and, if required, an integral component to the output signal dmnbeg of the rpm limiter. To form the proportional and, if required, integral components, an rpm value is formed from the engine rpm value nmot in a dead time member 116. This rpm value represents the reference value for the rpm for an occurring deceleration. The reference value is stored as soon as an accelerator pedal withdrawal with subsequent rpm increase has been detected. If such an rpm increase is recognized for a withdrawn accelerator pedal, the switching element 120 is switched over into the position shown in phantom outline by the output signal of the AND function 118 and the output of the dead time element 116 is fed back to its input, that is, the last detected rpm value is stored. The AND function 118 generates an output signal when the possibly limited output of the lowpass 102 is less than a pregiven limit value (this is determined in comparator 122 and the limit value is fixedly pregiven in the memory cell 124) and when the difference between the current engine rpm and the decelerated engine rpm is greater than 0. The difference between the two values is formed in the logic position 126 and the difference is compared to the threshold value zero in the threshold value stage 128. The difference is greater than zero when the current rpm is greater than the decelerated rpm, that is, when an rpm increase has taken place.

Accordingly, if the accelerator pedal is withdrawn (output of the lowpass filter is less than the threshold value) and if the engine rpm is increased (nmot is greater than the decelerated value), the then present rpm value is stored as a reference value. If the above-mentioned conditions are not satisfied, the switching element is again switched over into the position shown in solid outline.

The difference between rpm and decelerated rpm or reference rpm is then limited to positive values in a limiting element 130 and is multiplied in the logic position 132 by a factor KP whose value is stored in the memory position 134. The starting point of the logic position 132 is therefore the proportional component of the limiter output signal which is superposed onto the differential component in the logic position 114. As required, an integral component can be computed alternatively or in addition to the proportional component.

The sum of the proportional and differential components is formed in the logic position 114 and is weighted in the logic position 106 with the output signal of the lowpass 102, preferably multiplied. The output signal of the lowpass 102 is limited as may be required. The output value of this logic position defines a delta torque which is subtracted in logic position 136 from, for example, the desired torque mides pregiven by other control functions or by the driver in order to reduce the rpm overshoot. In the subsequent torque control 138, the reduced desired torque is converted into a desired charge, an ignition angle correction and, if required, into a number of cylinders to be suppressed and, by adjusting these values, the torque of the drive unit is adjusted to the desired torque (and therefore the rpm is adjusted to the limit rpm (=reference rpm)). The operation of the torque control 138 is known from the state of the art.

Furthermore, the sum of the proportional and differential components is supplied to a comparator 140 wherein this quantity is compared to a threshold value stored in a memory cell 142. If the position quantity exceeds this threshold value, the fuel metering to the engine is immediately shut off (B_sa) when, simultaneously (AND function 144), the overrun state (released accelerator pedal and high rpm) of the drive unit has been recognized (B_sab).

To ensure that the described rpm limiting does not cause any unwanted rpm hang-ups on the stored reference value, two further measures are provided. According to the first measure, the lowpass 102 and therefore its output signal are reset or the output signal is continuously returned to zero by a switchover of the input to a positive value when the rpm deviation, which is formed in the logic position 126, drops below a pregiven reference value. This is checked in the comparator 146 with the reference value being supplied from the memory cell 148.

The second measure comprises that, for a positive gas push (for example, for a rapid actuation of the accelerator pedal), the lowpass and therefore its output signal is very rapidly returned again to zero. This is not shown in FIG. 2.

So that for positive rpm gradients and slightly negative values of the output of the lowpass 102 there is not always a torque reduction for limiting rpm, the output signal of the lowpass 102 fwdwp is only switched in via a flip-flop 150 (starting from the value zero) when there is a drop below a trigger threshold for possible overshoots. Such positive rpm gradients or slightly negative values of the output of the lowpass 102 can, for example, occur by pushing the engine with only a slight withdrawal of the accelerator pedal. The flip-flop 150 is set when the AND function 118 outputs an output signal. As mentioned above, this is the case when the output of the lowpass 102 drops below a pregiven threshold value and the difference between the rpm values, which is formed in the logic position 126, exceeds the value zero. In this case, the flip-flop 150 generates a signal which switches the switch element 152 from the position shown in phantom outline over into the position shown in solid. In the last position, the output of the lowpass is used for weighting the torque reduction signal in the logic position 106; whereas, in the other case, the weighting factor is zero, that is, no limiting or torque reduction takes place.

Furthermore, there can be no return switching of the weighting signal to the value zero when the trigger threshold is exceeded in the comparator 122. If this were the case, a torque jump would take place when the rpm limiter is still active for a slow depression of the accelerator pedal. For this reason, the flip-flop 150 is only then reset when the output of the lowpass 102 has reached the value zero. This is determined in the comparator position 154. In this way, a continuous torque reduction to the value zero is ensured.

It is furthermore provided that the limiter is switched off during a transmission intervention of an automatic transmission (while it is active during shift operations of a manual switch) in order to avoid unwanted effects during switching operations. This is ensured by the switch element 156 which, for an active transmission intervention (a corresponding information is preferably supplied by the transmission control 158) switches over the switch element from the solid position into the phantom outline position. In the last situation, the value zero is supplied to the logic position 136 so that no torque reduction is undertaken.

In the event that the holding time of the rpm limiting after withdrawal of the accelerator pedal by the time constant of the lowpass 102 is not sufficient, then, in one embodiment (not shown), this time constant is extended in that the lowpass input for a wanted holding time extension is switched over to the value zero starting with the sign change of the lowpass input (accelerator pedal gradient).

In one embodiment, an integrator is used for deceleration in lieu of a lowpass.

Figure 3A:
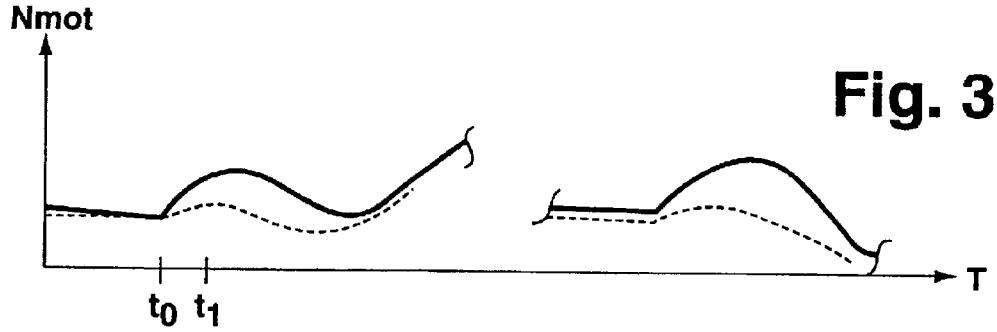
Figure 3B:
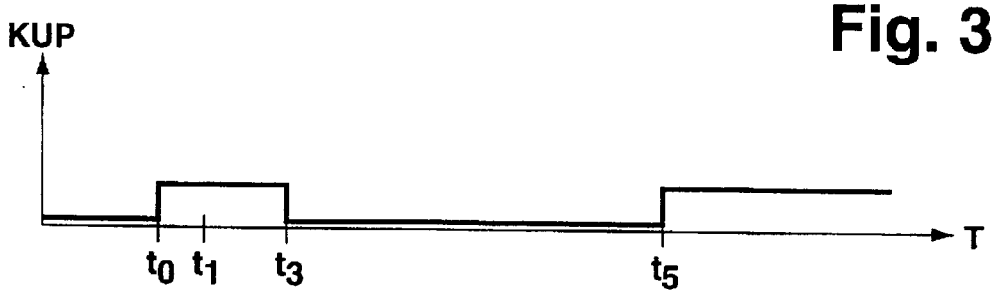
Figure 3C:
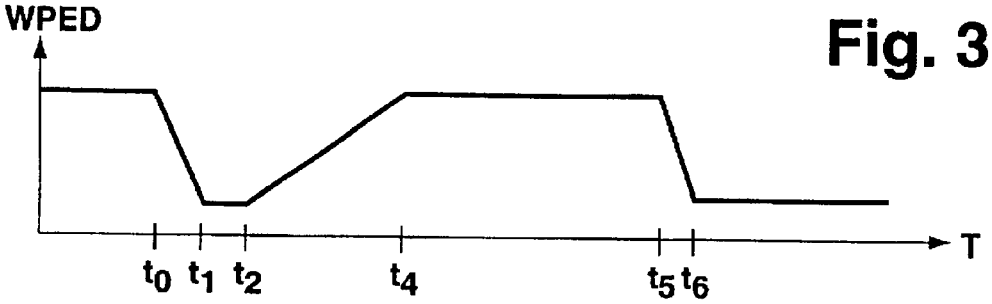
Figure 3D:
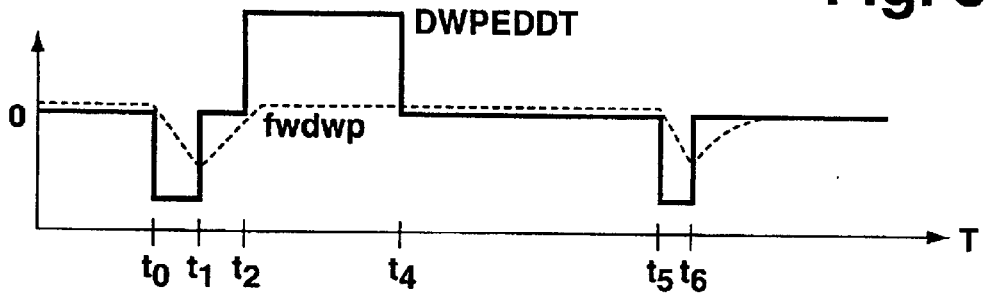

FIGS. 3*a* to 3*d* show time diagrams which explain the operation of the procedure presented above. In FIG. 3*a*, the time-dependent trace of the engine rpm nmot is shown (solid line is without a limiter and the broken line is with a limiter). In FIG. 3*b*, the time-dependent trace of the actuating state of the clutch KUP is shown and, in FIG. 3*c*, the time-dependent trace of the accelerator pedal position wped is shown. In FIG. 3*d*, the time-dependent trace of the gradient of the accelerator pedal position dwpeddt (solid line) and the output signal fwdwp of the lowpass 102 (broken line) is shown.

First, it is assumed that the accelerator pedal is actuated. A specific engine rpm adjusts and the clutch is not actuated, that is, the friction connection is present (FIG. 3*d*). Correspondingly, the accelerator pedal position gradient as well as the output signal of the lowpass 102 is zero. At the time point t0, the driver triggers the accelerator pedal (see FIG. 3*c*) and furthermore actuates the clutch (see FIG. 3*b*). As a consequence of the interrupted friction connection, this leads to an increase of the rpm (see FIG. 3*a*). In a conventional system without the procedure described above, a considerable rpm increase (see FIG. 3*a*, solid line) occurs as a consequence of the dashpot function. When utilizing the above-described procedure, a limiting of the engine rpm is carried out by the negative output signal fwdwp in accordance with FIG. 3*d* between the time point t0 and t2. As shown by the broken line in FIG. 3*a*, the overshoot, which follows the time point t0, is therefore considerably reduced. With the actuation of the accelerator pedal when reestablishing the friction connection, the output value fwdwp is returned to zero. Starting at time point t5, a further situation is shown wherein the corresponding effect is illustrated. Here too, the rpm overshoot is considerably reduced compared to the known system because of the limiting of the rpm when releasing the accelerator pedal (see FIG. 3*a*, broken line).

In the above, the accelerator pedal signal is used as the trigger signal for the rpm limiting. In other embodiments, in lieu of the accelerator pedal position, a driver command signal, which is derived from this accelerator pedal position signal, is utilized, for example, a driver command torque or the throttle flap angle (throttle flap position). The driver command is understood as a term including all of the above.

It is understood that the foregoing description is that of the preferred embodiments of the invention and that various changes and modifications may be made thereto without departing from the spirit and scope of the invention as defined in the appended claims.

What is claimed is:

1. A method for controlling a motor of a vehicle, the method comprising:

determining the rpm of said motor and a quantity representing a command of the driver of the vehicle;

determining a reference rpm of said motor at the start of a withdrawal of said command by the driver; and, limiting the rpm of said motor to said reference rpm when the driver withdraws said command.

2. The method of claim 1, wherein said motor includes a throttle flap and said vehicle includes an accelerator pedal, said method comprising the further step of deriving the withdrawal of said command of the driver from the position of the accelerator pedal or from the position of the throttle flap.

3. The method of claim 2, wherein the limiting of said rpm is active with shifting operations.

4. The method of claim 1, wherein said motor includes an rpm limiter, said method comprising the further steps of:

ascertaining the extent of a negative change of said driver command; and, storing a value over a pregiven time up to the end of the negative change of the command of the driver with said value functioning as a weighting quantity for the rpm limiter.

5. The method of claim 1, wherein said motor includes an rpm limiter, said method comprising the further step of storing the current motor rpm as a reference rpm for the rpm limiter when reaching a trigger threshold because of the negative change of the driver command.

6. The method of claim 4, comprising the further step of returning the weighting quantity for the rpm limiter continuously to zero for a renewed positive command change of the driver.

7. The method of claim 4, comprising the further step of returning or resetting the weighting quantity to zero when the rpm of said motor drops below said reference rpm.

8. The method of claim 4, wherein the weighting quantity is limited to a minimum value.

9. The method of claim 1, wherein said motor includes an rpm limiter and said rpm limiter reduces at least one of the charge and the ignition angle of the motor.

10. The method of claim 1, wherein said motor includes an rpm limiter and the rpm limiter triggers suppressions of injections when overrun cutoffs or injection suppressions are permitted.

11. The method of claim 1, wherein said motor includes an rpm limiter and the rpm limiter generates a torque reducing output signal in dependence upon the deviation of the motor rpm from said reference rpm.

12. An arrangement for controlling a motor of a motor vehicle, the arrangement comprising:

a control unit for determining the rpm of the motor and for determining a quantity representing a command of the driver;

said control unit functioning to generate an output signal in dependence upon said rpm and said quantity for controlling said motor;

said control unit including means for determining a reference rpm at the start of a withdrawal of the command of the driver;

said control unit including means for forming a limiting signal in dependence upon the rpm of said motor and said reference rpm when the command of the driver is withdrawn; and, said control unit including means for correcting said output signal with said limiting signal.

13. A computer program product comprising program code means which are stored on a computer readable data carrier for carrying out a method for controlling a motor of a vehicle when the program product is executed on a computer, the method including the steps of determining the rpm of said motor and a quantity representing a command of the driver of the vehicle; determining a reference rpm of said motor at the start of a withdrawal of said command by the driver; and, limiting the rpm of said motor to said reference rpm when the driver withdraws said command.

* * * * *